US006045875A

United States Patent [19]

Ishino

[11] Patent Number: 6,045,875

[45] Date of Patent: Apr. 4, 2000

[54] PROCESS AND APPARATUS FOR APPLYING A PRIMER

[75] Inventor: Shigeo Ishino, Aichi Pref., Japan

[73] Assignee: NGK Insulators, Ltd., Nagoya, Japan

[21] Appl. No.: 09/031,565

[22] Filed: Feb. 26, 1998

[30] Foreign Application Priority Data

Mar. 19, 1997 [JP] Japan ..... 9-066019

[51] Int. Cl.[7] ..... B05B 7/04; B05D 1/34

[52] U.S. Cl. ..... 427/426; 427/421; 239/419.3; 239/427.5

[58] Field of Search ..... 427/421, 426; 239/419, 419.3, 427.5

[56] References Cited

U.S. PATENT DOCUMENTS

| | | | |
|---|---|---|---|
| 4,132,357 | 1/1979 | Blackinton | 239/11 |
| 4,396,651 | 8/1983 | Behmel et al. | 427/421 |
| 5,489,448 | 2/1996 | Jackson et al. | 427/421 |

*Primary Examiner*—Shrive Beck
*Assistant Examiner*—Jennifer Calcagni
*Attorney, Agent, or Firm*—Wall Marjama Bilinski & Burr

[57] ABSTRACT

A primer is thinly and uniformly applied by supplying a primer and a spraying air to a spray gun, in which an amount of the primer to be supplied to the spray gun is controlled, and a solvent for the primer is supplied to the spraying air to be supplied to the spray gun.

3 Claims, 2 Drawing Sheets

PROCESS AND APPARATUS FOR APPLYING A PRIMER

BACKGROUND OF THE INVENTION

1. Field of the Invention

This invention relates to a process and an apparatus for supplying a primer and spraying air to a spray gun to spray the primer.

2. Description of Related Art

Previously, in the manufacture of a polymer insulator, for example, a primer (priming agent such as an adhesive) is applied onto an outer surface of a rod-shaped FRP core as a workpiece, and then a shed made of silicone rubber or the like is molded thereon. When applying the primer on the outer surface of FRP core, it is known to apply the primer through use of an airless spray gun or to apply the primer through a spray gun under an operation of a worker.

However, when of applying the primer by using conventional airless spray gun, several problems arise.

For instance, in order to apply the primer thinly and uniformly, it becomes necessary to decrease the amount of the primer sprayed. However, airless spray guns supplying such a small spraying amount are not commercially available.

Moreover, inknown airless spray guns, the spraying amount can be decreased by decreasing a spraying pressure. However the spraying state is not stable and hence the primer can not be applied thinly and uniformly.

Additionally, the primer tends to deposit around nozzle portion of the spray gun thereby stopping the spraying.

In order to avoid the deposition of the primer around the nozzle portion of the spray gun, it is necessary to use a large-scale installation for isolating the whole of the spraying apparatus from the atmosphere.

On the other hand, there are also problems associated with applying primer by using a conventional spray gun.

Even though the spraying amount smaller than that of the airless spray gun, the spraying amount is still relatively large in commercially available spray guns.

Even though the spraying amount can be decreased by lowering the spraying pressure and the pressure applied to a liquid surface of the primer, the spraying state will not be stable. Thus, In addition, spraying still stops because the primer still deposits around the nozzle portion of the spray gun the primer can not be applied thinly and uniformly.

In order to avoid the deposition of the primer around the nozzle portion of the spray gun, it is therefore still necessary to use a large-scale installation for isolating the whole of the spraying apparatus from an atmosphere.

SUMMARY OF THE INVENTION

It is, therefore, an object of the invention to solve the aforementioned problems of the conventional technique. It is also an object to provide a process for applying a primer in which the spraying can stably be carried out even at a small spraying amount, and wherein deposition of the primer around the nozzle portion of the spray gun is substantially eliminated.

According to a first aspect of the invention, there is the provision of a process for applying a primer by supplying a spray gun with a primer and a spraying air. The process is characterized in that an amount of the primer to be supplied to the spray gun is controlled. Moreover a solvent for the primer is supplied to the spraying air supplied to the spray gun.

According to a second aspect of the invention, there is the provision of an apparatus for applying a primer, which comprises a spray gun, a primer container for storing a primer to be supplied to the spray gun, and a high pressure generating device for supplying a spraying air to the spray gun, characterized in that means for controlling an amount of the primer to be supplied to the spray gun is disposed between the spray gun and the primer container, and means for supplying a solvent for the primer to the spraying air is disposed between the spray gun and the high pressure generating device.

According to the invention, the stable spraying can be attained even at a small spraying amount by controlling the amount of the primer to be supplied to the spray gun and hence the primer can be applied thinly and uniformly, while the deposition of the primer around the nozzle portion of the spray gun can be prevented by supplying the solvent for the primer to the spraying air to be supplied to the spray gun.

BRIEF DESCRIPTION OF THE DRAWINGS

The invention will be described with reference to the accompanying drawings, wherein.

DESCRIPTION OF PREFERRED EMBODIMENTS

Figure 1:
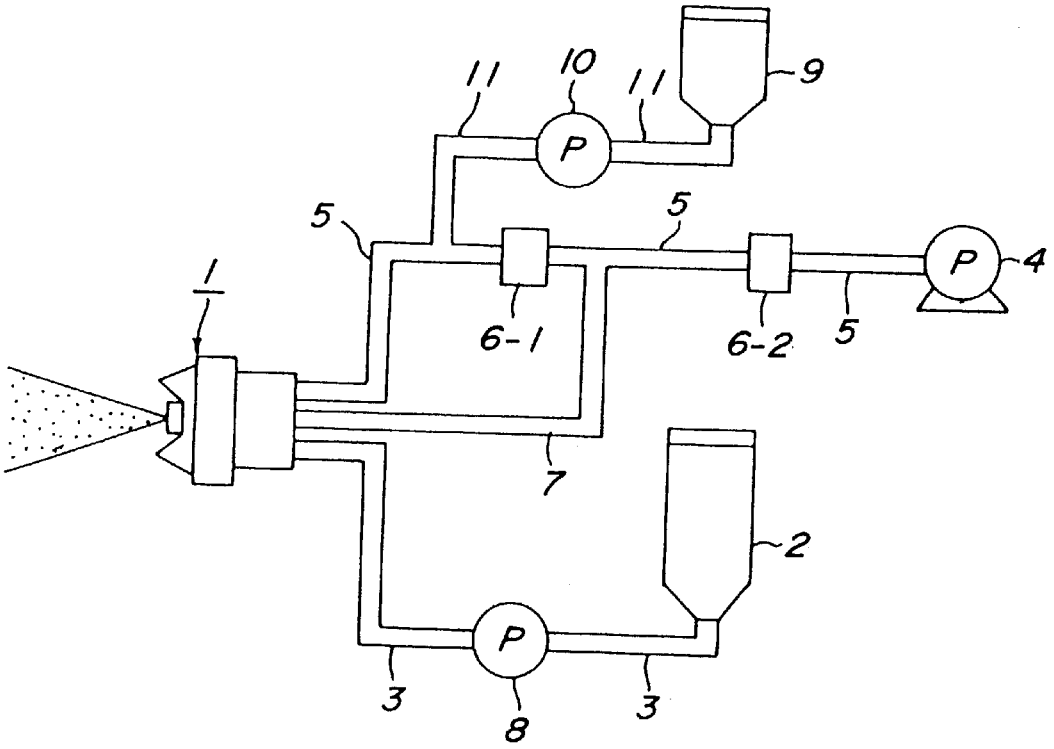
FIG. 1 is a schematic view illustrating an embodiment of the primer applying apparatus according to the invention.

FIG. 1 is a schematic view illustrating an embodiment of the structure of the primer applying apparatus according to the present invention. As shown in FIG. 1, the primer applying apparatus according to the invention comprises a spray gun 1, a primer container 2 for storing a primer to be supplied to the spray gun 1, a primer supplying pipe 3 connecting the spray gun 1 to the primer container 2, a compressor 4 as a high pressure generating device for supplying a spraying air to the spray gun 1, a spraying air supplying pipe 5 connecting the spray gun 1 to the compressor 4, and regulators 6-1 and 6-2 disposed in the spraying air supplying pipe 5.

Furthermore, a working air supplying pipe 7 connects the spraying air supplying pipe 5 between the regulators 6-1 and 6-2 to the spray gun 1, and an opening and closing of a needle valve in the spray gun 1 is controlled by a pressure of air supplied through the working air supplying pipe 7. Moreover, a high pressure air discharged from the compressor 4 is supplied to the spraying air supplying pipe 5 and the working air supplying pipe 7, respectively, in which an amount of air passing through each pipe is controlled by driving the regulators 6-1 and 6-2.

The aforementioned structure is the same as that of the conventional primer applying apparatus. The primer applying apparatus according to the invention is entirely different from the conventional primer applying apparatus in a point that a tubular pump 8 is disposed in the primer supplying pipe 3 connecting the spray gun 1 to the primer container 2 as means for controlling an amount of the primer to be supplied to the spray gun 1 and a solvent supplying pipe 11 connecting a solvent container 9 for storing a solvent to a tubular pump 10 for controlling an amount of the solvent to be supplied from the solvent container 9 to the spraying air is disposed in the spraying air supplying pipe 5 connecting the spray gun 1 to the compressor 4 as means for supplying the solvent for the primer to the spraying air supplying pipe 5.

In the primer applying apparatus having the aforementioned structure according to the invention, the primer supplied from the primer container 2 is not only sprayed by the spraying air passing through the spraying air supplying pipe 5, but also, even in a negative pressure generated in the nozzle portion under an action of the spraying air, the amount of the primer passing through the primer supplying pipe 3 from the primer container 2 can evenly be decreased by the actuation of the tubular pump 8 disposed in the primer supplying pipe 3 as compared with that supplied in the conventional apparatus. As a result, the stable spraying can be conducted even at the spraying amount smaller than that of the conventional apparatus. On the other hand, a given amount of a solvent for the primer is added to the spraying air by the actuation of the solvent container 9 and the tubular pump 10, whereby the deposition of the primer existing around the nozzle portion of the spray gun 1 can be prevented.

The process for the application of the primer according to the invention can be conducted by controlling the amount of the primer to be supplied to the spray gun 1 through the actuation of the tubular pump 8 disposed in the primer supplying pipe 3, and by supplying the solvent for the primer to the spraying air to be supplied to the spray gun 1 through the supplying means disposed in the spraying air supplying pipe 5 or the supplying means comprising the solvent container 9 and the tubular pump 10 in the primer applying apparatus shown in FIG. 1.

Figure 2:
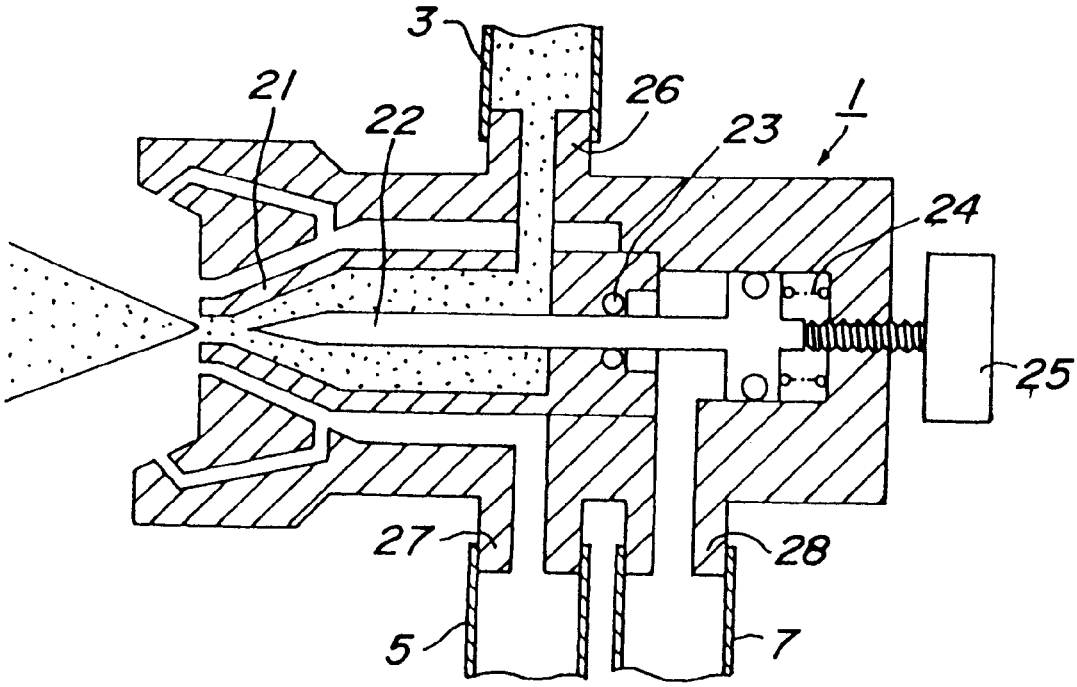
FIG. 2 is a diagrammatic view partly shown in section of an embodiment of the spray gun used in the primer applying apparatus according to the invention.

FIG. 2 shows an embodiment of the spray gun used in the primer applying apparatus according to the invention. In the embodiment of FIG. 2, numeral 21 is a nozzle, numeral 22 a needle valve, numeral 23 a needle packing, numeral 24 a spring, numeral 25 a member for adjusting a liquid amount, numeral 26 a primer supplying throat, numeral 27 a spraying air supplying throat, and numeral 28 a working air supplying throat. In the spray gun 1 shown in FIG. 2, the opening and closing of the needle valve 22 can be controlled by the spring 24 and air supplied through the working air supplying pipe 7 and the working air supplying throat 28. Further, air supplied through the spraying air supplying pipe 5 and the spraying air supplying throat 27 is jetted out from a circumference of the nozzle 21 outward, and the primer supplied through the primer supplying pipe 3 and the primer supplying throat 26 can be sprayed from a tip of the nozzle 21 accompanied with the jetting. Moreover, the structure of the spray gun 1 shown in FIG. 2 is the same as that of the conventional spray gun.

As seen from the above, according to the invention, the amount of the primer to be supplied to the spray gun is controlled, so that the stable spraying can be attained even at a small spraying amount and hence the primer can be applied thinly and uniformly. Further, the solvent for the primer is supplied to the spraying air to be supplied to the spray gun, so that the deposition of the primer around the nozzle portion of the spray gun can be prevented.

What is claimed is:

1. A process for uniformly applying a thin film of solvent-primer mixture from a spray gun, comprising the steps of:

mixing air and solvent to form an air-solvent mixture;

supplying the air-solvent mixture to a spray nozzle head of the spray gun via a first conduit;

simultaneously supplying primer to the spray nozzle head via a second conduit, said second conduit including a primer pump for supplying the primer;

simultaneously supplying air to the spray nozzle head via a third conduit to maintain a needle valve of the spray nozzle head in an open position; and controlling (i) the position of the needle valve and (ii) operation of the primer pump to control the amount of primer ejected from the spray nozzle head.

2. The process of claim 1, wherein the first conduit includes a pump for pressurizing the solvent prior to mixing with the air.

3. The process of claim 2, wherein the pressure of the air is regulated before mixing with the solvent.

* * * * *